US007631392B1

(12) United States Patent
Meitz

(10) Patent No.: US 7,631,392 B1
(45) Date of Patent: Dec. 15, 2009

(54) VACUUM CLEANER WITH TRANSLUCENT BUMPERS

(75) Inventor: Denise A. Meitz, Hudsonville, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 336 days.

(21) Appl. No.: 11/552,366

(22) Filed: Oct. 24, 2006

(51) Int. Cl.
*A47L 9/30* (2006.01)

(52) U.S. Cl. ..... 15/325; 15/334; 15/339

(58) Field of Classification Search ..... 15/324, 15/325, 339; *A47L 9/30*
See application file for complete search history.

(56) References Cited

U.S. PATENT DOCUMENTS 4,392,271 A 7/1983 Sepke
6,289,552 B1 * 9/2001 McCormick ..... 15/324

* cited by examiner

*Primary Examiner*—David A Redding
(74) *Attorney, Agent, or Firm*—McGarry Bair PC

(57) ABSTRACT

A vacuum cleaner base has a brush chamber having at least a portion that is transparent, a brush rotatably mounted in the brush chamber, and an elastomeric bumper that surrounds at least three sides of the brush chamber. The bumper is translucent at least where it overlaps that portion of the brush chamber that is transparent.

15 Claims, 6 Drawing Sheets

VACUUM CLEANER WITH TRANSLUCENT BUMPERS

BACKGROUND OF THE INVENTION

1. Field of the Invention

The invention relates to suction cleaners, and in particular, to the brush chamber of a suction cleaner. In one of its aspects, the invention relates to a vacuum cleaner that has a translucent/transparent brush chamber.

2. Description of the Related Art

In order to facilitate the removal of stuck-on particles or particles embedded deep within a carpeted surface, suction cleaners often include at least one rotating brush adapted to agitate a surface being cleaned. Such a brush is typically located in a brush chamber, which is a housing that communicates fluidly with the suction nozzle in order to enable the suctioning of these agitated surfaces. In order to avoid causing damage to furniture and walls, the brush chamber is typically covered with an opaque bumper to absorb any inadvertent impact. However, as the bumper is usually made of a black or dark grey material, it will tend to leave scuff marks on any accidentally contacted object. Moreover, it would be advantageous for a user of such a cleaner to be able to view the interior of the brush chamber in order to determine operational conditions, such as whether or not the brush is operating properly. Users can also determine the point at which the cleaning of a surface is complete by viewing the quantity of particles moving through the interior of the brush chamber, as no particles will be seen moving through the brush chamber if the surface is relatively clean.

BISSELL Homecare, Inc. presently manufactures and sells in the United States an upright vacuum cleaner that has a brush chamber. The brush chamber is partly constructed of a translucent material enabling the viewing of a portion of the interior of the brush chamber. An opaque bumper surrounds a greater portion of the brush chamber. The bumper prevents marring of furniture and other objects in its path; however, a user is prevented from viewing the majority of the brush.

U.S. Pat. No. 4,392,271 to Sepke discloses an upright vacuum cleaner employing a small transparent window positioned on a top portion of the brush chamber above a belt used for rotating the brush. The belt includes markings viewable through the window for determining the speed at which the brush rotates. The housing is opaque for the greater part thereof, and thus does not enable viewing of the remaining portion of the brush chamber.

SUMMARY OF THE INVENTION

A vacuum cleaner according to the invention has a base for movement along a surface to be cleaned. The base has a brush chamber having at least a portion that is transparent, a brush rotatably mounted in the brush chamber, and a bumper that surrounds at least three sides of the brush chamber. The bumper is formed of an elastomeric material. The bumper is at least partially transparent at least where it overlaps with that portion of the brush chamber that is transparent.

The portion of the brush chamber that is transparent can be at least a front portion thereof. The front portion can have an upper edge that curves upwardly from the sides thereof. The portion of the brush chamber that is transparent can also include side portions thereof. The side portions can form a semi-circular configuration.

The bumper of the vacuum cleaner can be made of any suitable clear elastomeric material. The elastomeric material can be selected from the group consisting of an elastomeric form of polyvinyl chloride, clear polyurethane/urea elastomers, optically clear copoly (carbosilane and siloxane) elastomers, and optically clear silicone polymers.

DESCRIPTION OF THE PREFERRED EMBODIMENT

Figure 1:
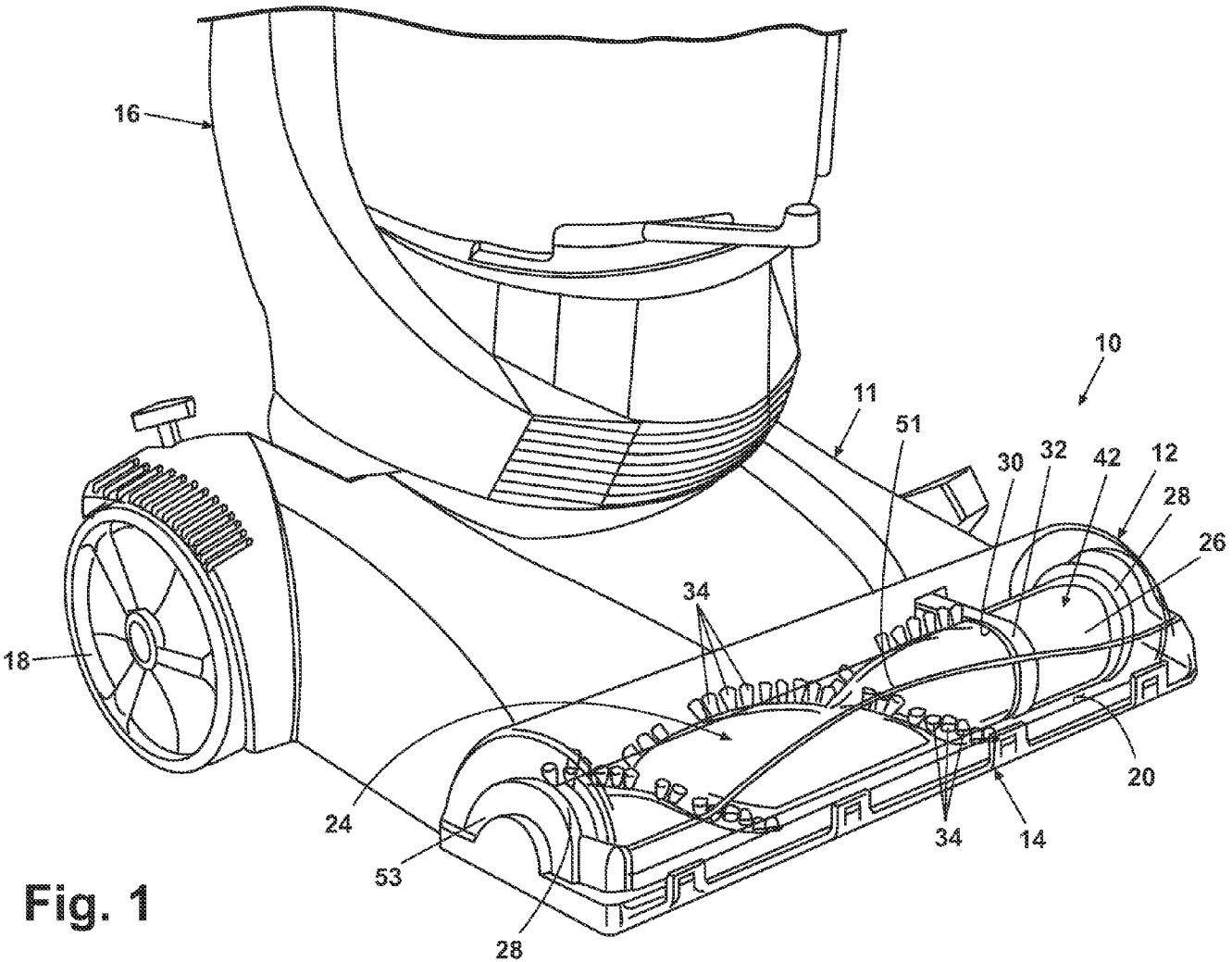
FIG. 1 is a right perspective view of the base portion of an upright vacuum cleaner according to the invention.
Figure 2:
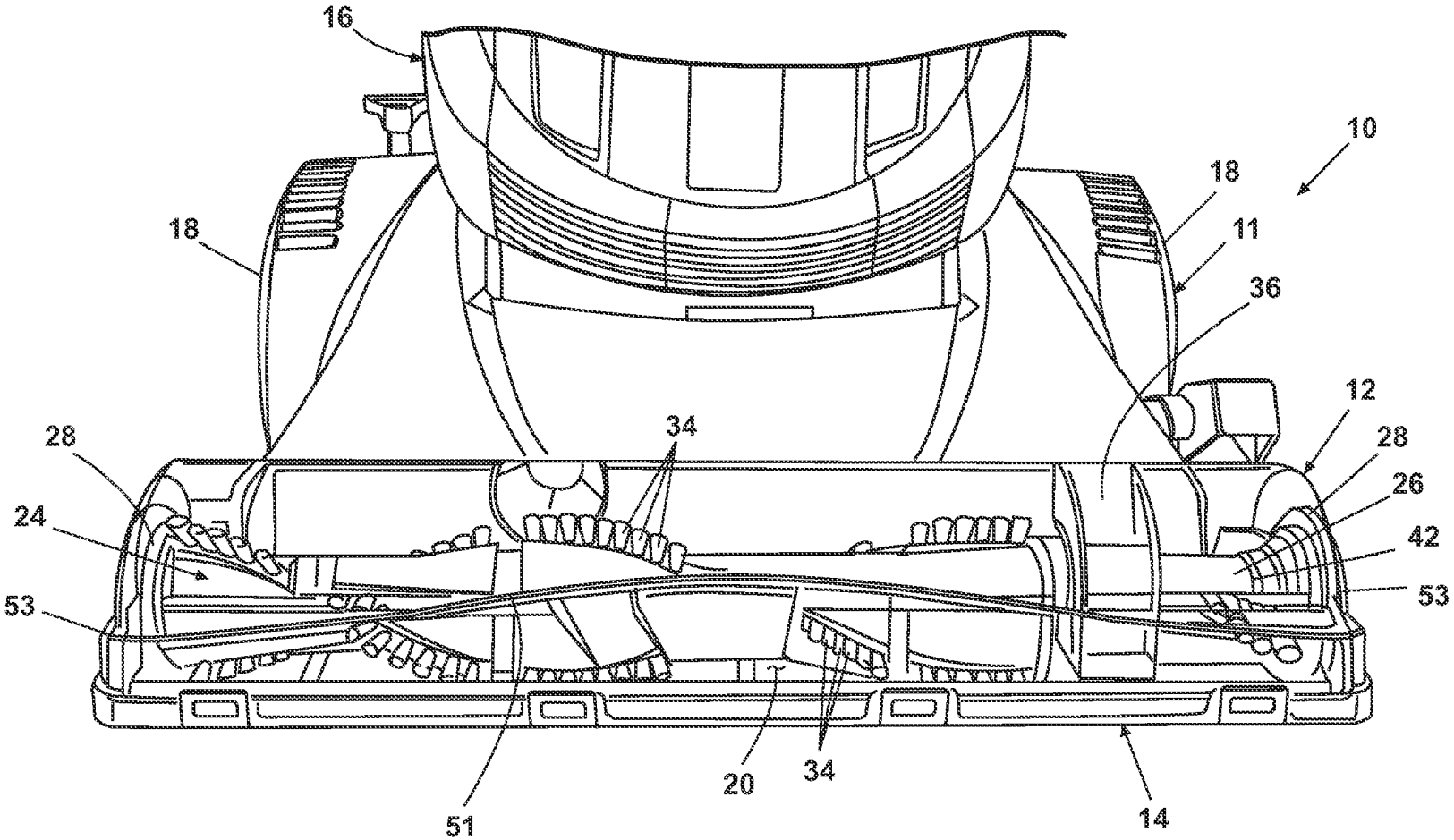
FIG. 2 is a front perspective view of the base portion of FIG. 1.
Figure 3:
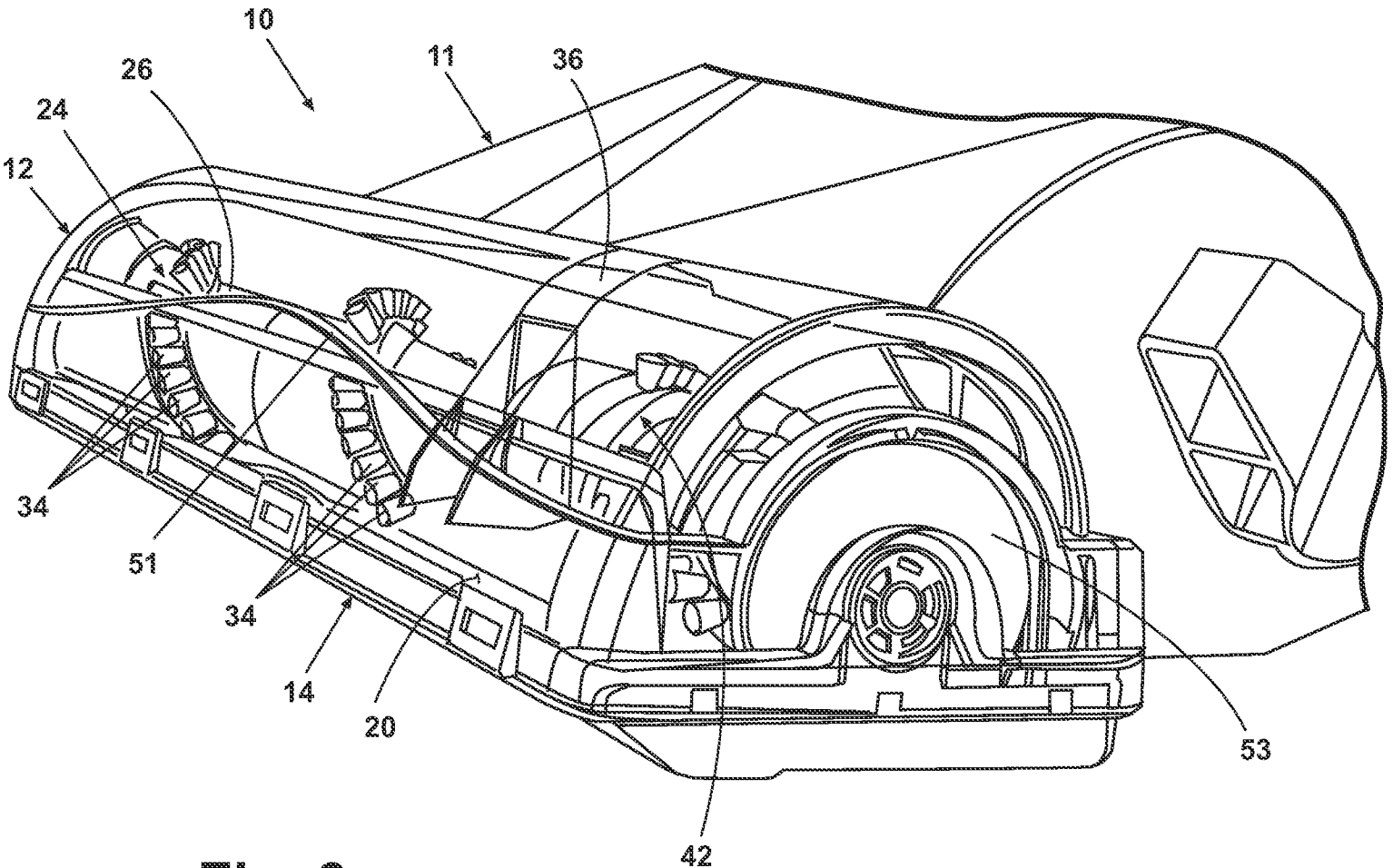
FIG. 3 is a left front perspective view of the base portion of FIG. 1.

Referring to the drawings and to FIGS. 1-3 in particular, an upright vacuum cleaner base assembly 10 comprises a base portion 11, brush chamber 12, and bumper 14. An upright assembly 16 is pivotally mounted to the base assembly 10, as is well-known in the art. Although the description of the invention is related to an upright vacuum cleaner, the concept embodied in this invention can also be applied to other suction-powered vacuum cleaners and including wet extractors and wet/dry vacuums found in upright, canister, and portable hand-held configurations. Furthermore, the invention can be adapted to accessory tools incorporating a rotating brush as found on canister wand attachments and above floor hose tools. The upright assembly 16 comprises elements common to an upright assembly of a vacuum cleaner, such as a grip (not shown) to facilitate movement by the user, a motor/fan assembly (not shown), and a dirt separation and collection assembly (not shown). A suitable example of an upright assembly 16 as described is shown in PCT/US Patent Application No 06/26696 and is incorporated herein by reference.

Figure 4:
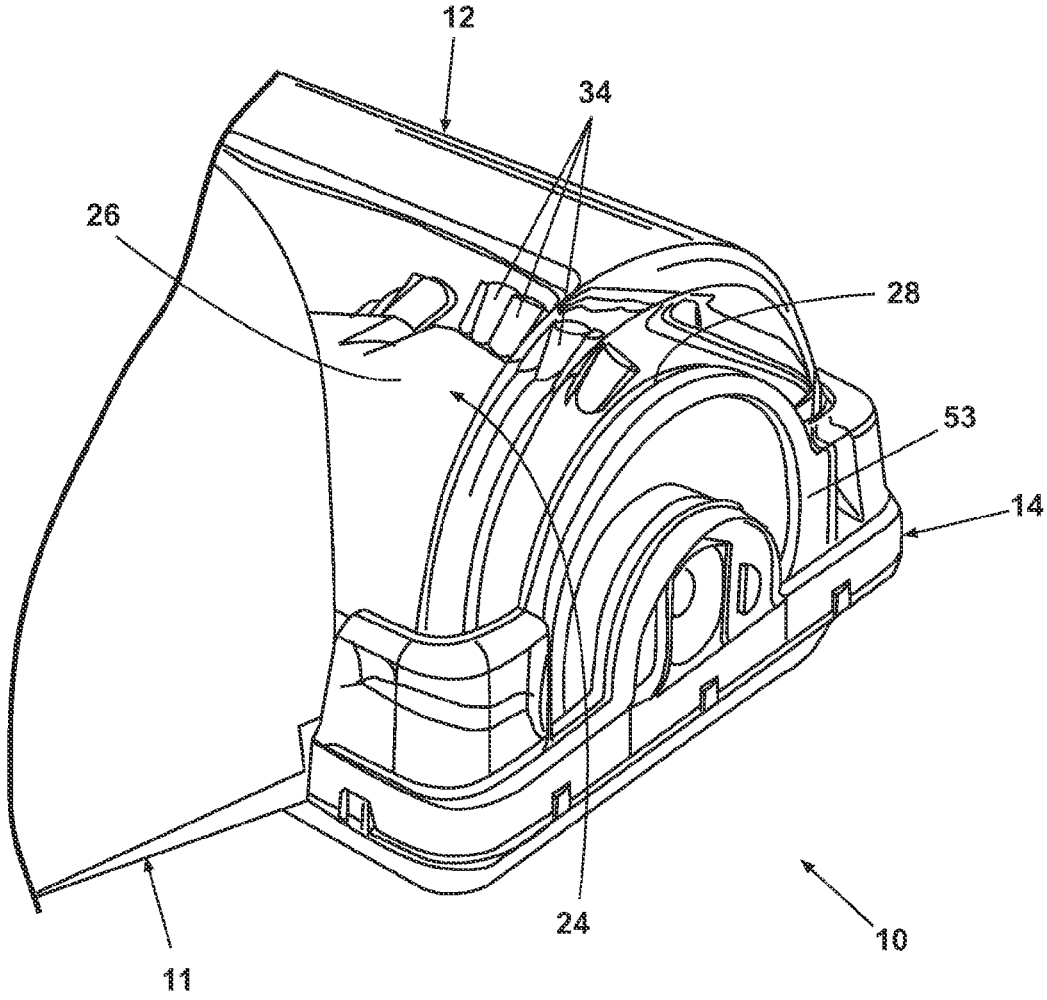
FIG. 4 is a partial perspective view of a portion of the brush chamber and bumper as viewed from the right rear as shown in FIG. 1.
Figure 5:
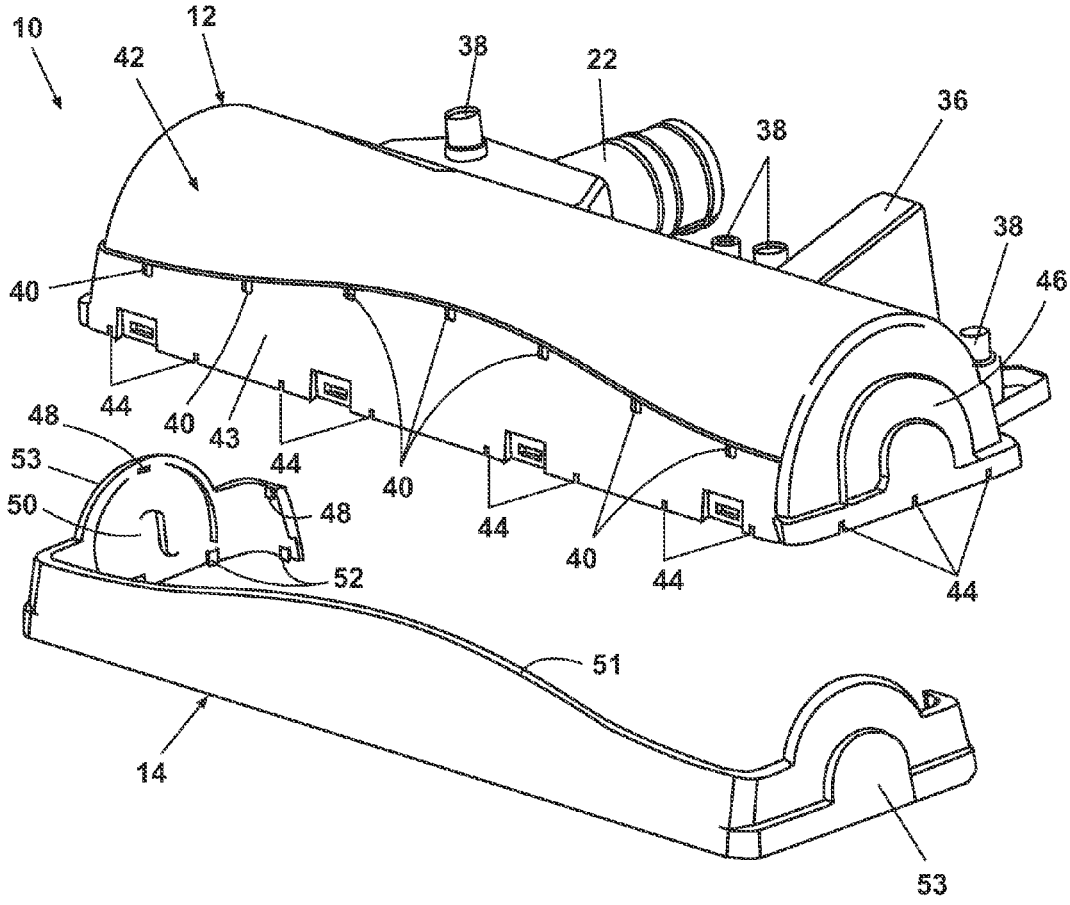
FIG. 5 is a partial top exploded view of the brush chamber and bumper of FIG. 1.
Figure 6:
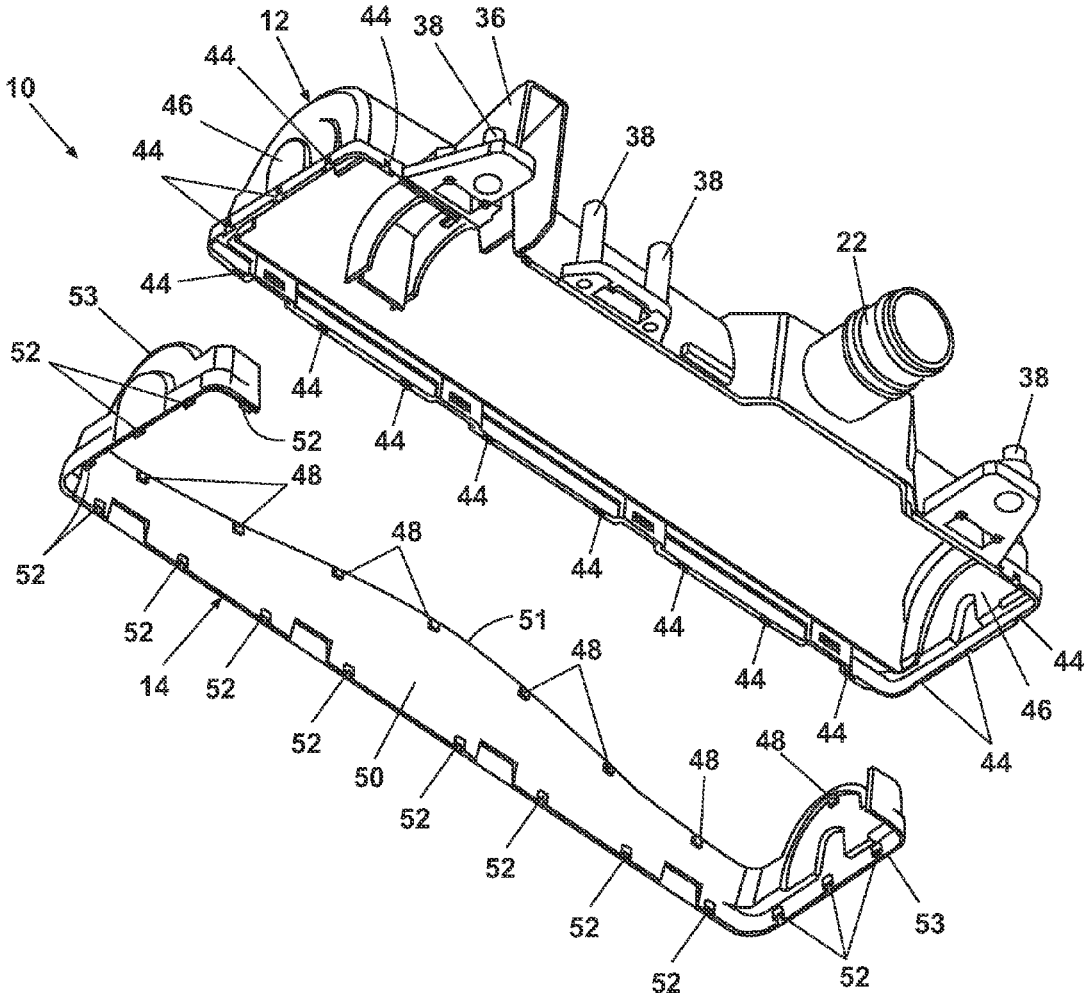
FIG. 6 is a partial lower rear exploded view of the brush chamber and bumper of FIG. 1.

With continued reference to FIGS. 1-3 and also to FIGS. 4-6, the brush chamber 12 is positioned at a front end of the base portion 11. The base portion 11 of the base assembly 10 can comprise a number of elements common to a base assembly of an upright vacuum cleaner, such as pair of rear wheels 18 secured to a rearward portion of the base portion 11, rearward being defined relative to the brush chamber 12. The base portion 11 can vary in width so that the cleaning path can be narrower or wider depending upon the size of the brush chamber 12.

A suction nozzle 20 is formed at a lower surface of the brush chamber 12 on the base assembly 10 and is in fluid communication with the surface to be cleaned. An air path conduit 22 provides an air path from the suction nozzle 20 through the base assembly 10 to the dirt separation and collection assembly. The conduit 22 is preferably a smooth rigid tube formed integrally with the brush chamber 12. The brush chamber 12 is preferably integrally formed of a transparent polymer, such as polymethyl methacrylate.

A rotating brush roll assembly 24 is positioned within the brush chamber 12. The brush roll assembly 24 comprises a generally cylindrical brush dowel 26 with a bearing surface 28 on each end and a belt engagement surface 30 around the circumference near one end that communicates with a brush belt 32. A plurality of flexible bristles are inserted into the outer circumference of the brush dowel 26 forming individual tufts 34, as is well known in the art. A belt chamber 36 is also integrally formed in the brush chamber 12 and extends rearward to provide a space for the brush belt 32 to mechanically connect to a motor (not shown) located within the base portion 11 when the brush roll assembly 24 is positioned in the brush chamber 12.

The brush chamber 12 further includes a plurality of integrally formed mounting elements 38, such as positioning pins, on its rearward portion. The mounting elements 38 are mountable to the base portion 11. The brush chamber 12 also includes a plurality of integrally formed mounting lugs 40 oriented generally orthogonal to the bumper 14 and located on a bumper-receiving portion 43 of a front exterior surface 42. Preferably, the bumper-receiving portion 43 is shaped similarly to the bumper 14 and is recessed relative to the rest of the front exterior surface 42. A plurality of integrally formed retaining surfaces 44 formed by apertures and oriented generally orthogonal to the bumper 14 are located on a lower portion of the front exterior surface 42. Two brush receiving recesses 46 are located on each interior side of the brush chamber 12 and are adapted to rotably receive each bearing surface 28 of the brush roll assembly 24.

The bumper 14 is integrally formed of a translucent or clear elastomeric material, such as polyvinyl chloride (PVC) or polyurethane/urea elastomers, and is adapted to fit snugly around the front and sides of the exterior of the brush chamber 12, as well as a small portion of the rear of the brush chamber 12. The bumper 14 comprises a plurality of integrally formed lug slots 48 corresponding to the mounting lugs 40 of the brush chamber 12. The lug slots 48 are located on an upper portion of an interior surface 50 of the bumper 14. Preferably, the lug slots 48 extend downwardly from an upper edge 51 which curves upwardly from two side portions 53 of the bumper 14. The curvature of the upper edge 51 provides increased protection and is aesthetically pleasing. A plurality of integrally formed engaging surfaces 52 are formed on a bottom portion of the interior surface 50 that correspond to the retaining surfaces 44 on the bumper 14. The lug slots 48 receive the mounting lugs 40 and the retaining surfaces 44 receive the engaging surfaces 52 to fixedly attach the bumper 14 to the bumper-receiving portion 43 of the brush chamber 12. Typically, the bumper 14 is overmolded onto the brush chamber 12. The clear brush chamber 12 is typically made from an acrylic material that is clear and hard. The clear elastomeric bumper 14 does not readily adhere to the acrylic brush chamber and thus the lug slots are required to mechanically join the two parts. Otherwise, the elastomeric bumper will not adhere to the brush chamber 12

The bumper 14 serves to protect furniture and other objects from forward impacts of the vacuum cleaner during use, as is commonly known. However, the bumper 14 of the present invention is translucent and does not impede a user's ability to view the interior of the brush chamber 12. The bumper can be made of a variety of elastomeric materials that have the required softness and resilience to protect furniture and are also clear or at least partially transparent (translucent). These materials include elastomeric forms of polyvinyl chloride, clear polyurethane/urea elastomers, disclosed, for example in U.S. Pat. No. 5,962,619, optically clear copoly (carbosilane and siloxane) elastomers, as disclosed, for example in U.S. Pat. No. 7,071,244, and optically clear silicone polymers.

The brush chamber 12 and bumper 14 of the invention provide several advantages over the prior art. The transparent brush chamber 12 will not leave any marks if it contacts walls or furniture. The transparent brush chamber 12 also enables users to see the entirety of the interior of the brush chamber 12 while cleaning. Most notably, this will prevent damage to the vacuum because a user can easily identify potential problems, such as when an object becomes lodged or tangled about the brush roll assembly 24, or if the conduit 22 becomes clogged. A user can power off the vacuum and remove the problematic object before the vacuum breaks due to mechanical stress and strain or overheating of the motor.

In addition, a user can accomplish cleaning more efficiently using the brush chamber 12 and bumper 14 of the invention. Rather than guessing as to whether or not an area is clean, a user can clearly view the quantity of particles being suctioned through the brush chamber 12. Once it is observed that no more particles are being suctioned through the brush chamber 12, a user can either move to the next area requiring cleaning or power off the vacuum. Time and power are not wasted by continuing to vacuum an area that is already clean. Likewise, a user can see when an area is not completely clean, even though he or she may believe it has been cleaned for a sufficient amount of time. This ensures the thorough and proper cleaning of each surface being cleaned. In addition, the clear bumper has adds shelf appeal to the vacuum cleaner or extractor in that a potential customer can see the inside of the brush chamber with the machines on the shelf.

While the invention has been specifically described in connection with certain specific embodiments thereof, it is to be understood that this is by way of illustration and not of limitation. As can be appreciated by one of ordinary skill in the art, the invention can also be adapted to any suction cleaner employing a rotating brush, including wet extraction cleaners and wet/dry cleaners in an upright, canister, or portable hand held configuration. Reasonable variation and modification are possible within the scope of the forgoing disclosure and drawings without departing from the spirit of the invention which is defined in the appended claims.

What is claimed is:

1. A vacuum cleaner having a base for movement along a surface to be cleaned, the base having a brush chamber having at least a portion that is transparent;

a bumper on the brush chamber' and formed of an elastomeric material and positioned on the leading forward edge of the base;

wherein the bumper is at least partially transparent at least where it overlaps with that portion of the brush chamber that is at least partially transparent.

2. The vacuum cleaner of claim 1, wherein the portion of the brush chamber that is transparent is at least a front portion thereof.

3. The vacuum cleaner of claim 2, wherein the portion of the brush chamber that is transparent also includes side portions thereof.

4. The vacuum cleaner of claim 3, wherein the bumper has a front portion with an upper edge that curves upwardly from the sides thereof.

5. The vacuum cleaner of claim 4, wherein the bumper has side portions which form a semi-circular configuration.

6. The vacuum cleaner of claim 3, wherein the bumper has side portions which form a semi-circular configuration.

7. The vacuum cleaner of claim 2, wherein the bumper has a front portion with an upper edge that curves upwardly from the sides thereof.

8. The vacuum cleaner of claim 1, wherein the bumper has side portions which form a semi-circular configuration.

9. The vacuum cleaner of claim 1, wherein the bumper has a front portion with an upper edge that curves upwardly from the sides thereof.

10. The vacuum cleaner of claim 1, wherein the portion of the brush chamber that is transparent also includes side portions thereof.

11. The vacuum cleaner of claim 1, wherein the bumper is made of a clear elastomeric material.

12. The vacuum cleaner of claim 1, wherein the clear elastomeric material is selected from the group consisting of an elastomeric form of polyvinyl chloride, clear polyurethane/urea elastomers, optically clear copoly elastomers, and optically clear silicone polymers.

13. The vacuum cleaner of claim 1, wherein the bumper is made of polyvinyl chloride material.

14. The vacuum cleaner of claim 1 wherein the bumper is transparent.

15. The vacuum cleaner of claim 1 and further comprising a rotatable brush in the brush chamber.

* * * * *

UNITED STATES PATENT AND TRADEMARK OFFICE

CERTIFICATE OF CORRECTION

PATENT NO. : 7,631,392 B1
APPLICATION NO. : 11/552366
DATED : December 15, 2009
INVENTOR(S) : Denise A. Meitz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 388 days.

Signed and Sealed this

Second Day of November, 2010

David J. Kappos

David J. Kappos
*Director of the United States Patent and Trademark Office*